US005425346A

United States Patent [19]

Mavinahally

[11] Patent Number: 5,425,346

[45] Date of Patent: Jun. 20, 1995

[54] PERFORMANCE IMPROVEMENT DESIGN FOR TWO-STROKE ENGINES

[76] Inventor: Nagesh S. Mavinahally, 11592 Yarmouth Ave., Granada Hills, Calif. 91344

[21] Appl. No.: 120,545

[22] Filed: Sep. 14, 1993

[51] Int. Cl.[6] ..... F01P 1/04

[52] U.S. Cl. ..... 123/568; 123/65 P

[58] Field of Search ..... 123/568, 569, 570, 571, 123/585, 65 P, 73 AA, 73 D, 65 PE, 41.39, 65 E, 65 VB, 65 VC

[56] References Cited

U.S. PATENT DOCUMENTS

| | | | |
|---|---|---|---|
| 4,341,188 | 7/1982 | Nerstrom | 123/65 PE |
| 4,516,540 | 5/1985 | Nerstrom | 123/65 P |
| 4,550,696 | 11/1985 | Ehrlich | 123/73 D |
| 4,693,225 | 9/1987 | Abe et al. | 123/568 |
| 4,693,226 | 9/1987 | Choma | 123/568 |
| 4,735,186 | 4/1988 | Parsons | 123/568 |
| 4,995,354 | 2/1991 | Morikawa | 123/65 V |
| 5,121,719 | 6/1992 | Okazaki et al. | 123/585 |
| 5,285,752 | 2/1994 | Reed et al. | 123/61 R |

*Primary Examiner*—Henry C. Yuen
*Assistant Examiner*—M. Macy
*Attorney, Agent, or Firm*—Steven J. Rosen

[57] ABSTRACT

A two stroke engine having a variable inlet port timing device in conjunction with a piston port controlled timing apparatus for filling the top of transfer passages, that connect the crankcase chamber to the combustion chamber of the engine, with buffer gas such as exhaust gas or secondary air for the reduction of pollutants, improvement of performance, and delivery ratio of an internal combustion two-stroke engine and the like. Piston port controlled timing is provided by buffer air passages having a movable portion with inlet and outlet ports disposed through the piston. In another embodiment piston controlled selective exhaust gas recirculation is provided and a rotary valve in the exhaust gas recirculation passage is fitted to improve the performance of the engine. The pressure in the crankcase may be controlled by a rotary valve comprises a pair of rotary disc plates.

12 Claims, 10 Drawing Sheets

PERFORMANCE IMPROVEMENT DESIGN FOR TWO-STROKE ENGINES

FIELD OF THE INVENTION

This invention relates to exhaust gas recirculation for two-stroke internal combustion engines and in particular to two-stroke internal combustion engines having variable inlet port timing.

BACKGROUND OF THE INVENTION

This invention relates to a design for a two-stroke engine that reduces the exhaust pollutants and that improves the delivery ratio characteristics at a wide range of engine speeds. The delivery ratio is defined as the ratio of mass of delivered charge to displaced volume times the ambient density. Two-stroke engines are known for their simplicity and high specific output. However, they have drawbacks of poor emissions and efficiency characteristics. It is estimated that fuel consumption emissions of two-stroke engines are 1.5 to 2.0 times that of equivalent four-stroke engines and hydrocarbon emissions of two-stroke engines are 10–20 times that of equivalent four-stroke engines respectively. Some small utility engines produce up to 50 times the pollution of trucks on a per horsepower per hour basis. High unburned hydrocarbon emissions arise because in a carburetted two-stroke engine the scavenging process is carried out by a fresh mixture of air and fuel. Some of the air-fuel mixture mixes with the residual exhaust gas as it scavenges the cylinder and a small fraction of the charge is lost due to short circuiting. The net effect is that 25–40% of the charge may be wasted resulting in high fuel consumption and high levels of unburned hydrocarbons. It is believed that the fraction of the exhaust gas leaving the cylinder at a particular time is rich in unburned hydrocarbons. Investigations relating to delivery ratio and engine speed have shown that delivery ratio is dependent on engine speed for a given inlet port timing and for optimum delivery ratio inlet port timing is different for different speeds. It is the objective of this invention to recirculate that fraction of the exhaust gas rich in unburned hydrocarbons to minimize the pollutants and also improve the efficiency of the engine by way of trapping and recirculating the short circuited fresh charge and improve the delivery ratio over a wide range of speeds.

SUMMARY OF THE INVENTION

The recirculated exhaust gas and the secondary air that fills the top of the transfer passages, as the case may be, may be referred to as buffer gas for the purposes of this patent. A two stroke engine has recirculating passages and ports in a cylinder block and a piston to time the opening of a recirculating port and fill the top of the transfer passages with the exhaust gas. Non-return or check valves in the transfer passages prevent the back flow of recirculated exhaust gas and fresh charge into the exhaust gas manifold. Another embodiment provides a design to induct secondary air from the atmosphere in place of recirculated exhaust gas. According to yet another embodiment of the present invention an internal combustion engine having a rotary disc inlet valve is provided with means for varying the inlet timing, opening and/or closing. Variation in timing is achieved by altering the angular position, relative to the axis of disc rotation, of the leading and/or trailing edge of the rotary disc thereby varying the position on the crankshaft rotation cycle at which the inlet port opens and/or closes or by varying the phase relation to the disc relative to the crankshaft. This system is particularly adapted to be embodied in the intake and exhaust system of a two-stroke principle engine. The piston controls the buffer gas port timing and the height of the port determines the duration of the port open period for the recirculation of buffer gas into top of the transfer passages. One or two non-return or check valves, as the case may be, in the recirculating passages allow the buffer gas to flow in only one direction and prevent the back flow. In other embodiments of the present invention only air from the atmosphere is inducted into the top of transfer passages either directly or though passages controlled by the piston ports. In a more particular embodiment of the present invention the selective recirculation of exhaust gas is accomplished by a rotary valve that is provided in the exhaust manifold to help trap, at an appropriate time, the flow of exhaust gas into the recirculating passage. In all of the above three designs a variable inlet port timing device may be fitted to effectively regulate the flow of buffer gas.

ADVANTAGES

Normally the inlet port timing is compromised to obtain an optimum delivery ratio at a narrow range of engine speed. The present invention provides piston port controlled timing for filling of transfer passages with buffer gas such as either exhaust gas or secondary air which reduces pollutants and improves the performance and delivery ratio of an internal combustion two-stroke engine and the like. The present invention provides variable inlet port timing which offers flexibility to vary the inlet port timing in accordance with the engine speed. The timing can be varied manually, mechanically, electrically or electronically. Thus the variable inlet port timing design improves the delivery ratio characteristics for a wide range of engine speeds.

Note that the straight arrows in the accompanying drawings indicate the direction of flow of gases.

DESCRIPTION OF THE PREFERRED EMBODIMENT OF THE INVENTION

Figure 6:
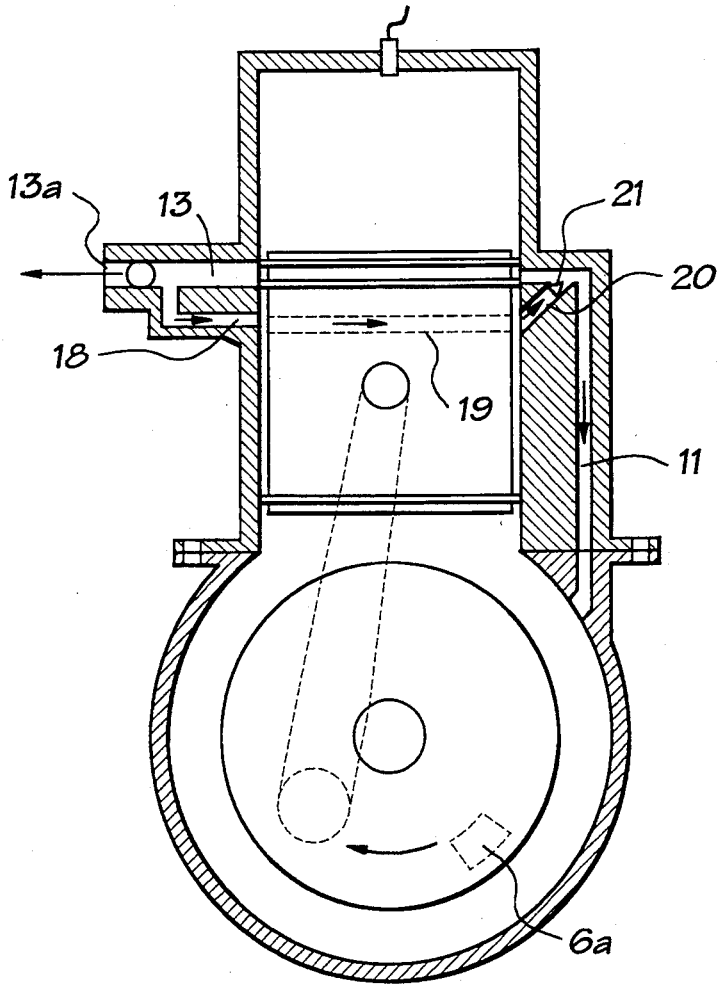
FIG. 6 is a sectional elevation showing an alternative embodiment of the present invention having a rotary valve driven by the engine, located in the exhaust manifold, and that is timed to direct the flow of exhaust gas either into the recirculating passage or into atmosphere as decided by the timing.
Figure 7:
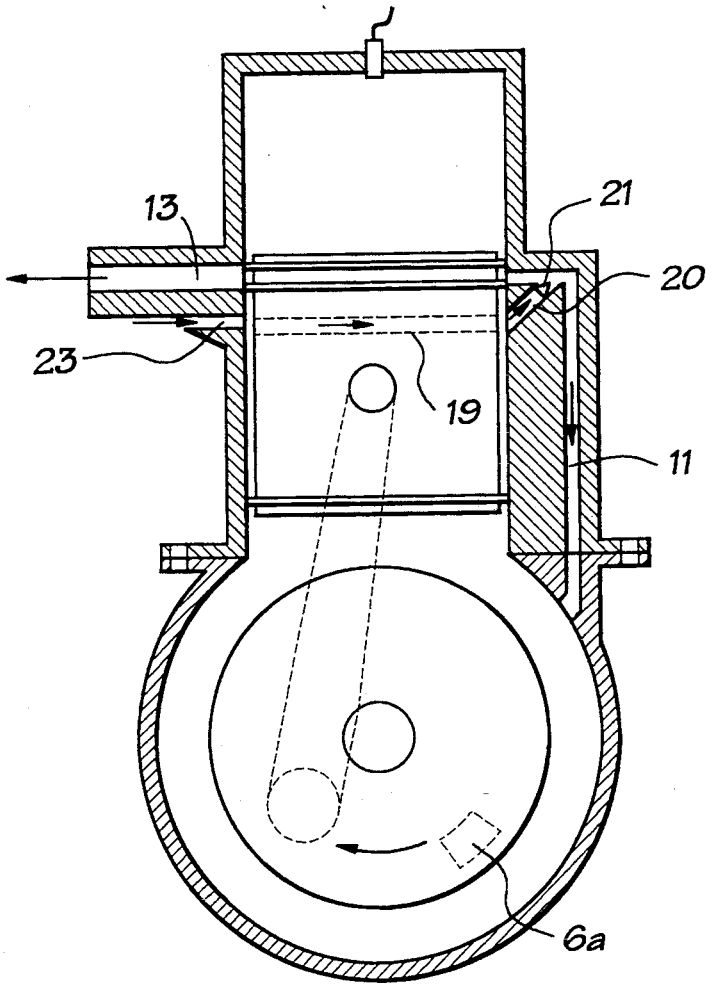
FIG. 7 is a sectional elevation showing an alternative embodiment of the present invention wherein only air from the atmosphere flows into top of the transfer passages controlled by the piston port.

A two-stroke crankcase compression engine having a selective exhaust gas recirculation system constructed in accordance with the invention are illustrated in the FIGS. 1 through 10. FIGS. 3, 4, 5, and 8 illustrate in detail the location of each passage and port. FIG. 6 illustrates the location of a rotary valve in the exhaust manifold. FIG. 7 illustrates a design in which only air is allowed to flow into top of the transfer passages and for which the flow is controlled by the piston port timing. The embodiment illustrated in FIG. 8, has secondary air directly inducted into the top of transfer passages as mentioned. In the illustrated embodiment the engine is a single cylinder type. It is to be understood, however, that the invention can be utilized in multi-cylinder type engines.

Figure 1:
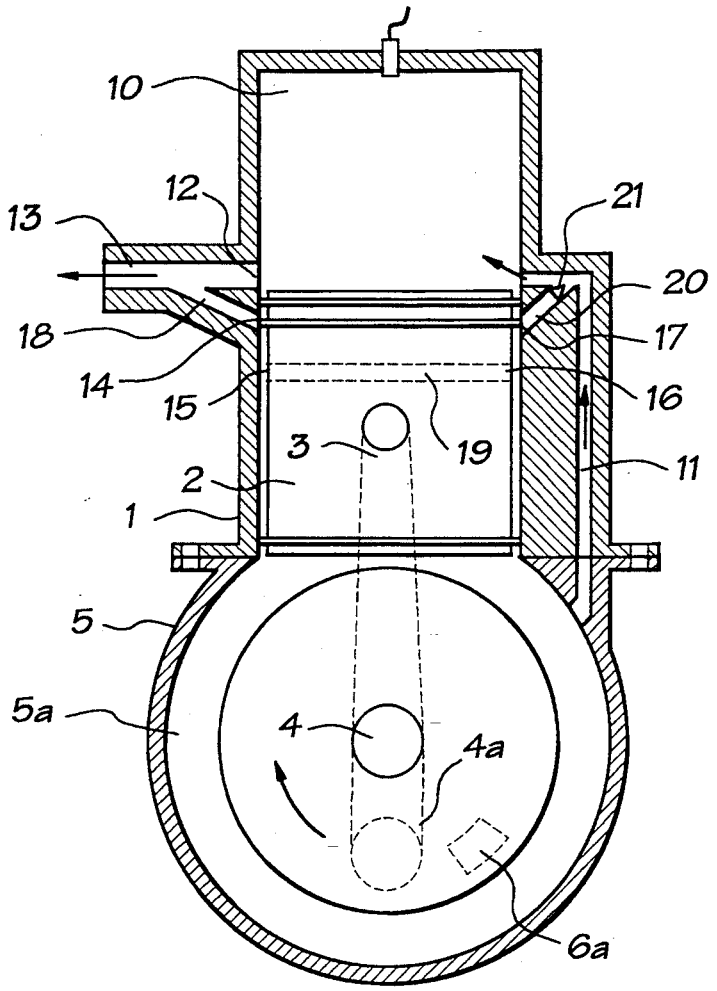
FIG. 1 is a sectional elevation of a two-stroke crankcase compression engine having a conventional rotary disc valve induction system constructed in accordance with a first embodiment of the present invention.
Figure 2:
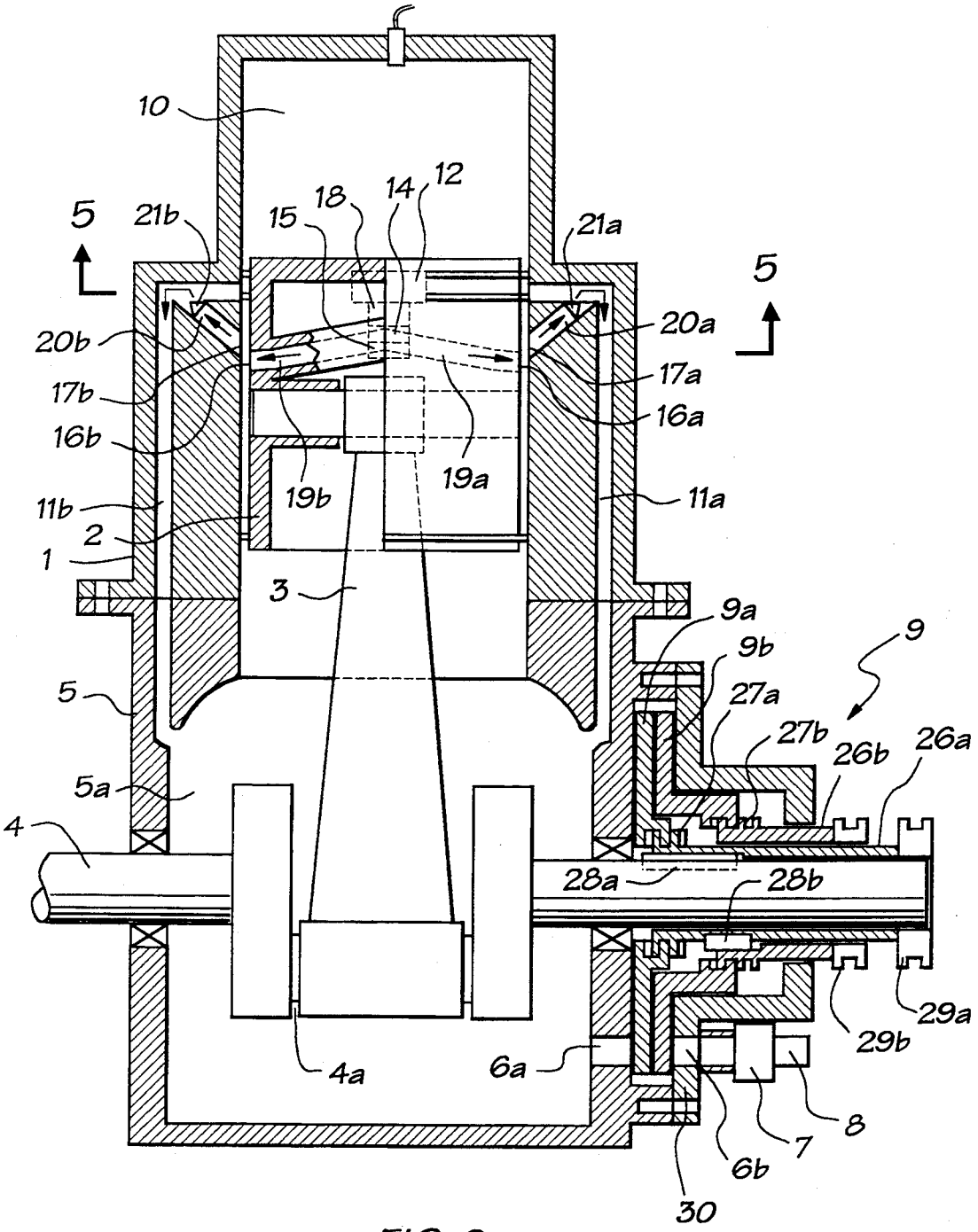
FIG. 2 is a cross-sectional view along the crankshaft of the two-stroke engine with two transfer ports having rotary disc valve induction system constructed illustrating the piston at a position where the recirculating piston port is beginning to open recirculating passages for the flow of buffer gas in accordance with a second embodiment of the invention illustrated in FIG. 1.
Figure 3:
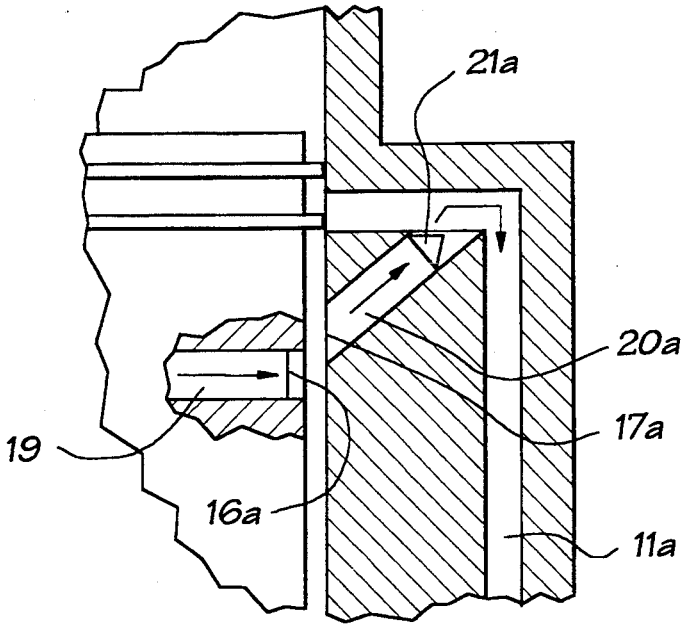
FIG. 3 is a partially cut-away enlarged cross-sectional view of the piston and the passages on the transfer port side of the engine in FIG. 2.
Figure 4:
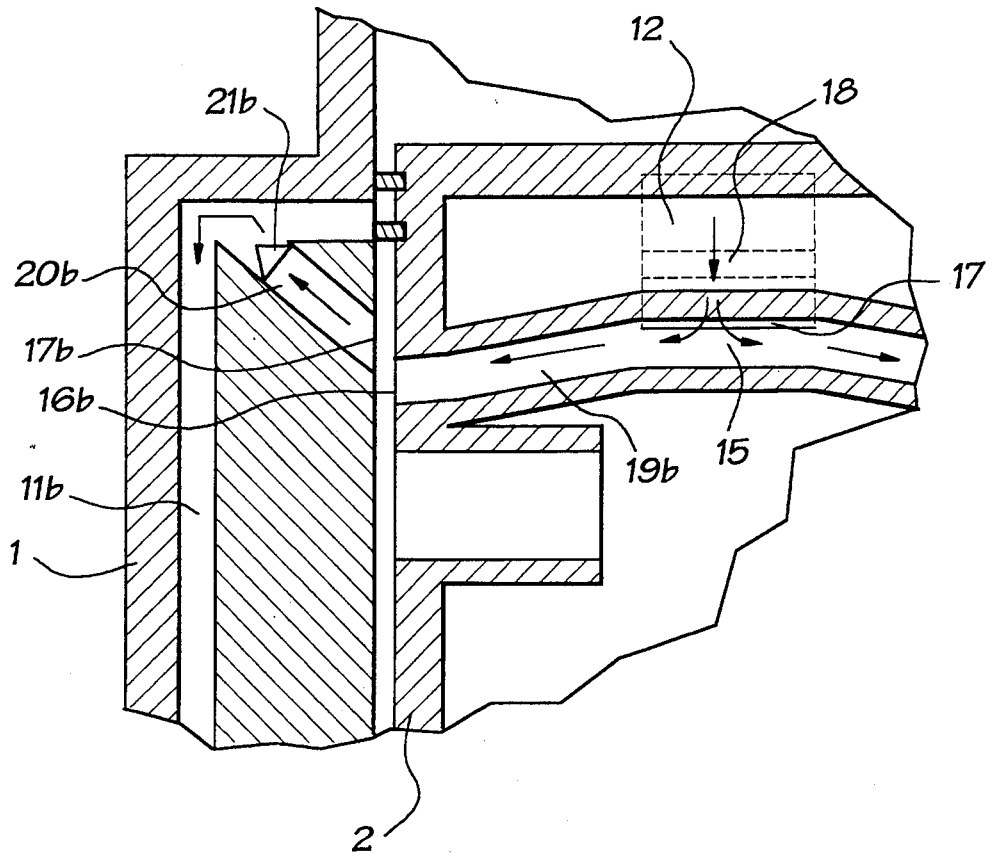
FIG. 4 is an enlarged cross-sectional view of a portion of engine in FIG. 2 illustrating the flow of exhaust gas into the transfer passages through the non-return valve.
Figure 5:
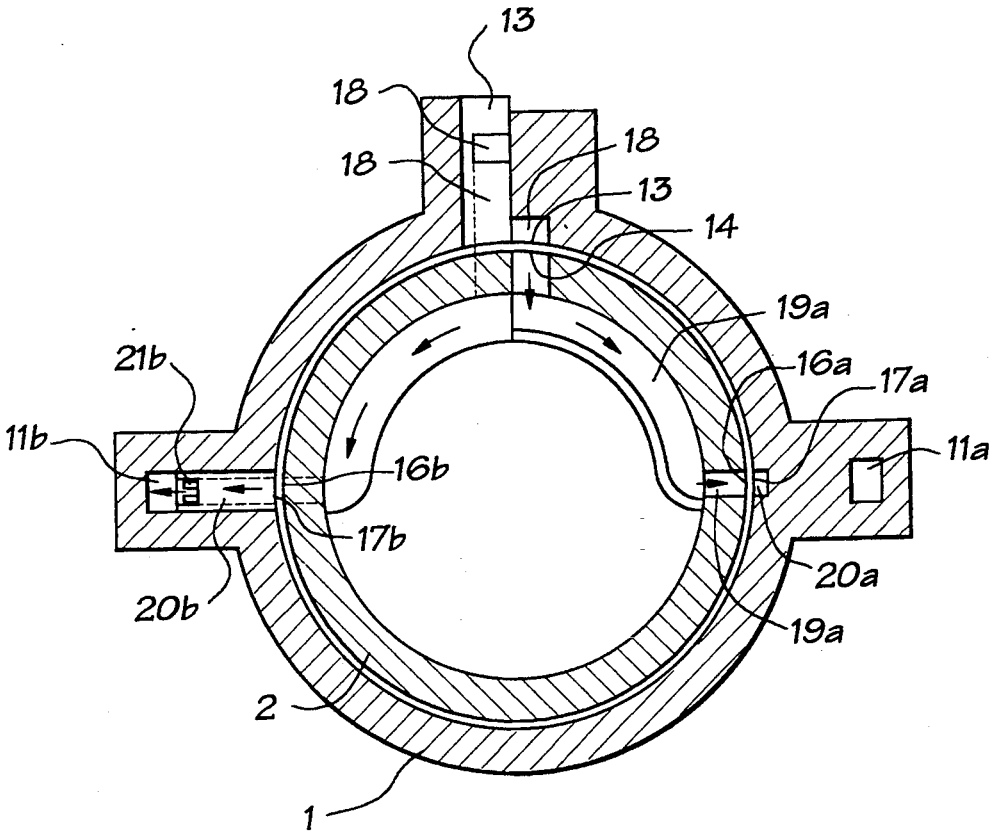
FIG. 5 is a top sectional view of the engine in FIG. 2 taken along the line 5—5 showing the recirculating passages in the cylinder block and in the piston with ports in the piston and cylinder block.

Referring to FIG. 1 and 2, the engine includes a cylinder block 1 that houses a cylinder bore 1*a*. A piston 2 reciprocates within the cylinder bore 1*a* and is connected by means of a connecting rod 3 to a crank throw 4*a* (shown in FIG. 2) of a crankshaft 4. The crankshaft 4 is journaled for rotation within a crankcase chamber 5*a* of a crankcase 5 that is affixed to the lower end of the cylinder block 1 in a suitable manner. Referring specifically to FIG. 2, the crankcase 5 has an inlet port 6*a* (also shown in FIG. 1) leading to a carburetor 7 which is affixed to the engine and has an air filter 8. A rotary disc valve assembly having a pair of rotary disc plates 9*a* and 9*b* are provided to time the opening and closing of the inlet port 6*a*, and precluding back flow of charge from the crankcase chamber 5*a* during downward movement of the piston 2. The fresh charge drawn into the crankcase chamber 5*a* is introduced into the combustion chamber 10 of the cylinder block 1 at the completion of the power stroke. The charge flows from the crankcase chamber 5*a* to the combustion chamber 10 through the transfer passage 11 in the embodiment illustrated in FIG. 1 and transfer passages 11*a* and 11*b* in an alternative embodiment illustrated in the FIGS. 2, 3, 4, 5, and 8. The exhaust gas flows out of the combustion chamber 10 through an exhaust port 12 and through an exhaust manifold 13 towards the end of the power stroke and during gas exchange process. However, it will be seen that, contrary to conventional construction of two-stroke engine, the present invention provides exhaust gas recirculating ports and passages in FIGS. 1, 2, 3, 4, 5, and 6, and a secondary air passage in FIG. 7 and secondary air passages in FIG. 8 that will be explained in the following paragraphs.

The gas exchange processes such as intake, blowdown, scavenging and exhaust are generally done as usual except that in this invention extra ports, passages and non-return valves are provided to selectively recirculate the unburned hydrocarbon rich exhaust gas to reduce pollutants and improve efficiency. In a conventional two-stroke engine the fresh charge that enters the combustion chamber first during the scavenging process is prone to be short circuited.

An engine in accordance with a first embodiment of the present invention is illustrated in FIG. 1 having a first exhaust side gas recirculating port 14 disposed through the cylinder block 1 and a first gas recirculating passage 18 connects the port 14 to the exhaust manifold 13. A second exhaust gas recirculating passage 19 is disposed through the piston 2 and has a second exhaust side gas recirculating port 15 that is alignable with the first exhaust side gas recirculating port 14. The second exhaust gas recirculating passage 19 has a first transfer passage side port 16 on the other side of the piston 2 that is alignable with a second transfer passage side port 17 disposed through the cylinder block 1. A third exhaust gas recirculating passage 20 leads from the second transfer passage side port 17 to the transfer passage 11 and a non-return valve 21 is disposed within the recirculating passage between the port 17 and the transfer passage 11 to prevent the reverse flow of gas in the transfer passage. An engine in accordance with a second embodiment of the present invention is illustrated in FIGS. 2, 3, 4, and 5 as having two transfer passages 11*a* and 11*b* and two sets of exhaust gas recirculating passages. A fourth exhaust gas recirculating passage 19*a* and a fifth exhaust gas recirculating passage 19*b* lead from the second exhaust side gas recirculating port 15, similar to the port 15 in FIG. 1, in generally opposite directions through the piston 2 to oppositely located fourth and fifth transfer passage side ports 16*a* and 16*b* respectively that are alignable with third and fourth transfer passage side ports 17*a* and 17*b* respectively disposed through the cylinder block 1. Exhaust gas recirculating passages 18, 19, and 20 shown in FIGS. 1 and 6, and exhaust gas recirculating passages 18, 19*a*, 19*b*, 20*a* and 20*b* shown in FIGS. 2, 3, 4, and 5, carry the exhaust gas from the exhaust manifold 13 to the top of the transfer passages 11, shown in FIGS. 1 and 6, and 11*a* and 11*b* shown in FIGS. 2, 3, 4, and 5. In addition, extra non-return valves 21 in FIGS. 1, 6, and 7, and 21*a* and 21*b* in FIGS. 2, 3, 4, and 5 are provided at the end of recirculating passages 20, 20*a*, and 20*b* respectively to prevent the reverse flow of gas in the transfer passages.

Illustrated in FIG. 6 is another embodiment of the present invention in which the engine has a rotary valve 22, driven by the engine, in an exhaust passage 13*a* exiting from the exhaust manifold 13 to time the flow of exhaust either into the recirculating passage 18 or into the atmosphere through the exhaust passage 13*a*. The embodiment of the present invention illustrated in FIG. 7 flows air from the atmosphere passes through a secondary air passage 23 into the second exhaust gas recirculating passage 19. An additional feature provided in the embodiment of the present invention illustrated in FIG. 8, as mentioned, flows secondary air directly into top of the transfer passages 11*a* and 11*b* through non-return valves 24*a* and 24*b*. The air flowed through these valves may be regulated by means of a suitable throttle valve 25.

Figure 9:
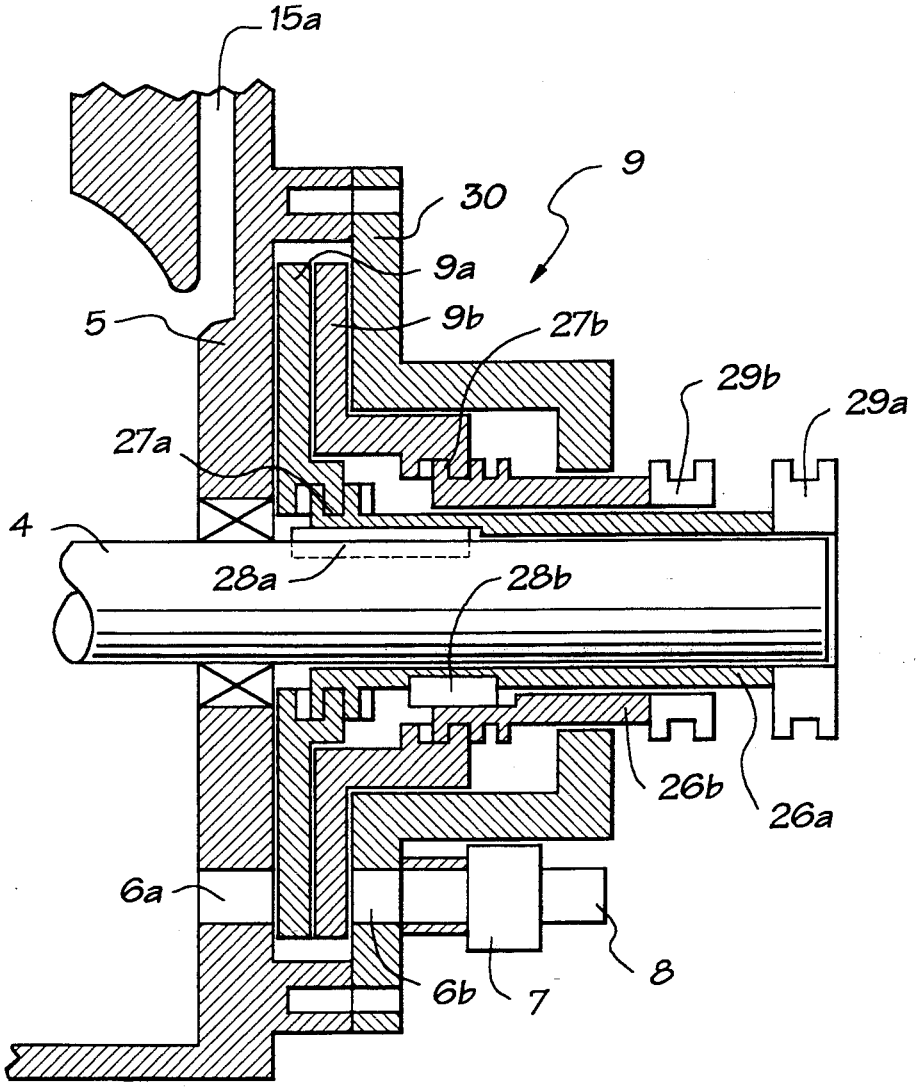
FIG. 9 is an enlarged sectional elevation of a portion of FIG. 2 illustrating in detail a rotary disc inlet valve for varying inlet port timing.
Figure 10:
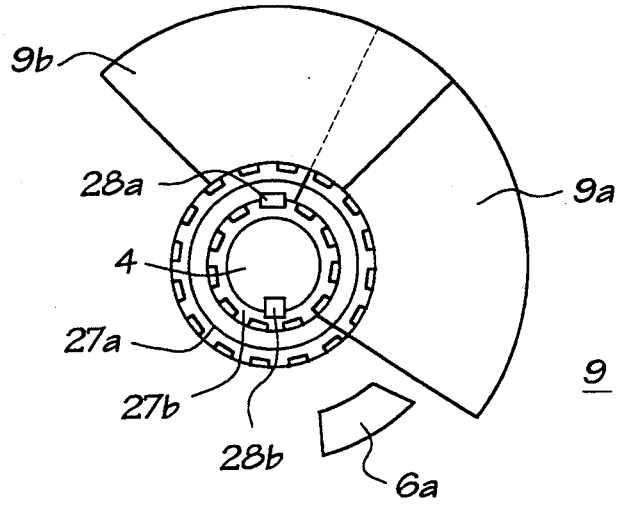
FIG. 10 is a plan view of the pair of rotary disc valves in FIG. 9.

The variable inlet port timing device 9, shown in FIG. 9 and illustrated in FIGS. 9 and 10, further includes the rotary disc valve having the pair of rotary disc plates 9*a* and 9*b* to time opening and closing of an inlet port 6*a* and preclude the back flow of charge during downward movement of the piston 2. Disc plate 9*a* is driven by inner sleeve 26*a* and disc plate 9*b* is driven by outer sleeve 26*b*. Inner and outer sleeves 26*a* and 26*b* have external first and second helical splines, 27*a* and 27*b*, respectively, that match internal splines on respective hubs at the center of the rotary disc valves 9*a* and 9*b*. The inner sleeve 26*a* is drivenly connected to the crankshaft 4 by means of a key 28*a* (or a splined connection may be used) and the outer sleeve 26*b* is similarly connected to the inner sleeve 26*a* by means of a key 28*b* (or a splined connection may be used). The sleeves have on their inner side key ways that are longer than the keys 28*a* and 28*b* which allow them to move axially. The outer ends of each sleeve have slotted bushings 29*a* and 29*b* rigidly fixed to them. Forks (not shown) engaging these bushings and impart axial movement to the sleeves which in turn rotate the disc valves with respect to the crankshaft and also with respect to each other because of the helical splines 27*a* and 27*b*. An outer cover plate 30 helps hold the rotary disc plates 9*a* and 9*b* preventing them from axial movement. The outer plate 30 has an inlet passage 6*b* aligning with the inlet port 6*a* in the crankcase 5.

DESCRIPTION OF THE OPERATION OF THE INVENTION

As the piston 2 moves towards top dead center the pressure in the crankcase chamber 5*a* drops. During this period, at a particular crank angle or the piston position, the recirculating ports are open aligning the recirculating passages for the induction of exhaust gas into the upper ends of the transfer passages 11 or 11*a* and 11*b* where it forms a protective cushion that is positioned to enter the combustion chamber ahead of the fresh charge. The timing and duration of the exhaust gas recirculating ports opening is a matter of convenience and designed so as to trap the particular fraction of the exhaust gas that is rich in unburned hydrocarbons.

As soon as the ports 14 and 15 are aligned and ports 16 and 17 are aligned the exhaust gas, which is at a higher pressure than the pressure in the crancase chamber 5*a*, begins to flow through the gas recirculating passages 18, 19, and 20 in FIG. 1 and 18, 19*a*, 19*b*, 20*a*, and 20*b* in FIGS. 2, 3, 4, and 5. Similarly in FIG. 2, the first and second exhaust side gas recirculating ports 14 and 15 respectively are aligned, and fourth transfer passage side port 16*a* and third transfer passage side 17*a* are aligned, and fifth transfer passage side port 16*b* and fourth transfer passage side port 17*b* are aligned. The exhaust gas continues to flow as long as these ports are aligned because the pressure in the crankcase chamber 5*a* is lower than the exhaust pressure in the exhaust manifold 13 due to upward movement of the piston 2. The induction of fresh charge takes place as usual through the inlet port 6*a* and inlet passage 6*b*, filling the crankcase chamber 5*a* with the fresh charge. During the recirculation of exhaust gas, fresh charge accumulated during the previous cycle in the transfer passage is flushed into the crankcase chamber. In this way exhaust gas forms a buffer screen between the fresh charge and the burned gas during the scavenging process.

After the closure of the recirculating ports the piston continues to move outward and the induction process continues in the usual manner. During the downward movent in the power stroke the recirculating ports are once again aligned. During this period the pressure in the crankcase chamber is higher than the exhaust pressure in the exhaust manifold 13, or at atmospheric or ambient pressure as the case may be, thus closing the non-return valve 21 in FIGS. 1, 6, and 7 and 21*a* and 21*b* in FIGS. 2, 3, 4, and 5. This precludes the reverse flow of gas in the transfer passage. In the following cycle the recirculated exhaust gas is utilized either to form a buffer volume that gets short circuited because it flows into the combustion chamber ahead of the fresh charge or is burned along with the fresh charge during the following combustion process.

In FIG. 6 the operating principle of exhaust gas recirculation remains same as previously explained. However, in this case with a rotary valve 22, the closing of the valve prevents the exhaust gas from flowing into the atmosphere through an exhaust pipe 13*a*, instead it positively directs the flow into the recirculating passage 18. The opening and closing is timed so as to direct the flow of exhaust gas, rich in unburned hydrocarbons, into the recirculating passage 18. There are published materials available on the use of rotary valves in the exhaust manifold to extract the unburned hydrocarbons and direct them into a separate passage. However, the present invention is unique in the sense that the extracted exhaust gas is recirculated into the transfer passages for subsequent burning in the following cycle and the gas flows through the internal passages in the piston. In addition the flow of exhaust gas is controlled by the piston port timing.

In FIG. 7 the operating principle for reduction of short circuit loss is provided by the introduction of a buffer volume of air ahead of the fresh charge. In this case secondary air is supplied through the secondary air passage 23, the second exhaust gas recirculating passage 19, and the third exhaust gas recirculating passage 20 into the top of the transfer passage 11 or passages 11*a* and 11*b*. In this way air forms a buffer screen between the fresh charge and the burned gas during the scavenging process. Therefore it will be air that may be lost due to short circuiting rather than fresh charge. In this way exhaust pollutants are reduced and a larger portion of fresh charge is retained in the combustion chamber. The flow of fresh air in the piston passages helps cool the piston as well.

Figure 8:
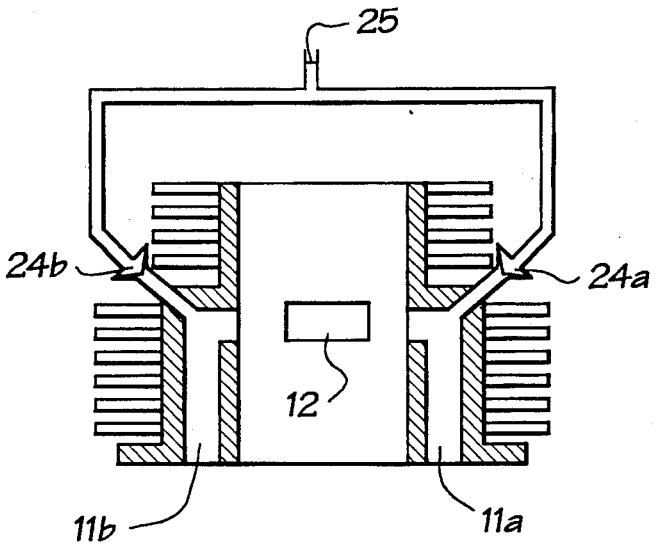
FIG. 8 is a cross-sectional view illustrating another alternative embodiment of the present invention wherein secondary air is inducted directly into transfer passage.

In FIG. 8, as mentioned earlier, secondary air is inducted directly into transfer passages 11*a* and 11*b* and is regulated by means of a throttle valve 25. The secondary air passage may have a separate filter or may be connected to the normal air filter provided at the inlet side of the carburetor. Again with respect to the drawing of FIG. 8, it is well known to induct secondary air directly into the transfer passages. However, the present invention is unique in the sense that the secondary air is regulated by means of varying the inlet port timing by means of rotary valves.

The rotary valve and its pair of rotary disc plates are rotatably mounted on a pair of sleeve structures which have external helical splines. The rotary disc valve plates have internal helical splines on tehir hubs. The inner sleeve is driven by the crankshaft through a key or straight spline which allows the sleeve to move axially. The outer sleeve is driven by the inner sleeve which has a key or straight spline and allows the outer sleeve to move axially. Axial movement of sleeves impart phase shift or angular shift to the rotary plates with respect to the crankshaft thus allowing for additional control of air entering the crankcase. Angular rotation can be controlled either manually, electrically, electronically, or mechanically. This mechanism provides an option to vary the opening independent of the closing time and closing time independent of the opening. In principle the mechanism can either advance or retard the opening of inlet port. Similarly it can, independent of opening, either advance or retard the closing of inlet port. Therefore inlet port timing can be matched with any engine speed to improve the delivery ratio characteristics of the engine at all speeds.

As mentioned earlier one of the governing factors for the quantity of buffer gas flowing into the transfer passages is the pressure difference. In the case of using secondary air for buffer gas, external pressure may remain constant, i.e. atmospheric. In the case of using exhaust gas for buffer gas, the pressure varies according to load, speed, and exhaust tuning. However, at the lower pressure side, that is in the crankcase, the pressure is determined by the engine speed, load, and inlet port timing. At a given speed the crankcase pressure depends on the throttle opening, it is higher at higher loads and lower at low loads. Therefore the flow of buffer gas is effected by this pressure variation in the crankcase. The flow drops with the increase in load, particularly in the case of using secondary air for buffer gas. Experimental investigations have proven this effect. This is where the variable inlet port timing device comes handy. By suitably altering the inlet port opening time enough pressure drop in the crankcase can be achieved to induct sufficient buffer gas at all speeds and loads. At higher speeds the inlet port closing time can be altered to improve the delivery ratio characteristics. At starting and idling the inlet port closing time can be advanced to prevent back flow of charge. Therefore, the present invention of variable inlet port timing device in conjunction with buffer gas induction into top of the transfer passages offers a two-stroke internal combustion engine and the like a unique design to control pollutants, improve fuel efficiency, and delivery ratio characteristics throughout a wide range of operating speeds and loads.

I would state in conclusion that while the illustrated example constitute a practical embodiment of my invention. I do not limit myself strictly to the exact details herein illustrated since manifestly the same can be considerably varied without departing from the spirit of the invention.

I claim:

1. A two-stroke internal combustion engine comprising:

a transfer passage between a crankcase chamber and a combustion chamber of the engine, a buffer gas passage in gaseous communication with a top portion of said transfer passage, and a means to selectively provide buffer gas to fill said top portion of said transfer passage during a portion of a cycle of the engine.

2. The engine according to claim 1 wherein said buffer passage comprises first, second, and third sections wherein, said first section has three interconnected parts, a first part leading from said combustion chamber, a second part leading from an exhaust manifold, and a third part leading from a first port into a cylinder bore of said engine, said second section is disposed through a cylinder of said engine and said cylinder is operably disposed in said cylinder bore, said second section has a second port through said cylinder at a first end of said second section and a third port through said cylinder at a second end of said second section, said third section has a fourth port into said cylinder bore of said engine and connects to said top portion of said transfer passage, and said first and second ports are alignable and said third and fourth ports are alignable simultaneously during a portion of a stroke made by said piston.

3. The engine according to claim 2 wherein said buffer gas is exhaust gas from the engine and said buffer gas passage is an exhaust gas recirculating passage leading from said combustion chamber.

4. The engine according to claim 2 wherein said buffer gas is fresh air and said buffer gas passage is secondary air passage in gaseous communication with air outside the engine.

5. The engine according to claim 3 wherein said third section has a non-return valve disposed between said fourth port and said top portion of said transfer passage.

6. The engine according to claim 2 wherein said second section is bifurcated to so as to provide a fourth section of said buffer passage said fourth section having a third end with a fifth port through said cylinder, a second transfer passage is disposed between said crankcase chamber and said combustion chamber of the engine, said buffer passage has a fifth section with a sixth port into said cylinder bore of said engine and connects to a top portion of said second transfer passage, and said fifth port and sixth ports are alignable simultaneously with said first and second ports and with said third and fourth ports during a portion of a stroke made by said piston.

7. The engine according to claim 6 wherein said fifth section has a non-return valve disposed between said sixth port and said top portion of said second transfer passage.

8. The engine according to claim 3 further comprising:

an inlet port disposed through a crankcase surrounding said crankcase, a rotary disc valve assembly to time the opening and closing of the inlet port to ambient air and preclude a back flow of charge from said crankcase chamber during downward movement of said piston.

9. The engine according to claim 8 wherein said rotary disc valve assembly has two rotary disc valves.

10. The engine according to claim 1 further comprising:

an inlet port disposed through a crankcase surrounding said crankcase, a rotary disc valve assembly to time the opening and closing of the inlet port to ambient air and preclude a back flow of charge from said crankcase chamber during downward movement of said piston, and wherein said buffer gas is fresh air and said buffer gas passage is a secondary air passage in gaseous communication with air outside the engine.

11. The engine according to claim 10 wherein said secondary air passage is controlled by a throttle valve.

12. The engine according to claim 5 wherein said second part of said first section of said buffer passage has a rotary valve disposed between said exhaust manifold and a juncture of said first, second, and third parts of said first section of said buffer passage.

* * * * *